US009713879B2

(12) United States Patent
Samuels et al.

(10) Patent No.: US 9,713,879 B2
(45) Date of Patent: Jul. 25, 2017

(54) ADJUSTABLY POSITIONABLE RAZOR ASSEMBLY

(71) Applicants: Pedro A. Samuels, Scarbourough (CA); Corine R. Samuels, Scarbourough (CA)

(72) Inventors: Pedro A. Samuels, Scarbourough (CA); Corine R. Samuels, Scarbourough (CA)

( * ) Notice: Subject to any disclaimer, the term of this patent is extended or adjusted under 35 U.S.C. 154(b) by 0 days.

(21) Appl. No.: 14/923,342

(22) Filed: Oct. 26, 2015

(65) Prior Publication Data

US 2016/0046029 A1 Feb. 18, 2016

Related U.S. Application Data

(63) Continuation-in-part of application No. 13/653,990, filed on Oct. 17, 2012, now abandoned.

(51) Int. Cl.
*B26B 21/52* (2006.01)
*B26B 21/40* (2006.01)

(52) U.S. Cl.
CPC ..... *B26B 21/521* (2013.01); *B26B 21/4062* (2013.01); *B26B 21/52* (2013.01); *B26B 21/523* (2013.01); *B26B 21/527* (2013.01)

(58) Field of Classification Search
CPC ..... B26B 21/00–21/16; B26B 21/22; B26B 21/40; B26B 21/4012; B26B 21/52–21/528
USPC ..... 30/47–51, 526–541; D28/46–48
See application file for complete search history.

(56) References Cited

U.S. PATENT DOCUMENTS 360,159 A * 3/1887 Keating ..... B26B 21/52 30/47
756,615 A * 4/1904 Fornander ..... B26B 21/52 30/527
971,772 A * 10/1910 Millar ..... B26B 21/14 30/526
1,201,317 A * 10/1916 Lishawa ..... B26B 21/527 30/526
1,966,307 A * 7/1934 Ohmer ..... B26B 21/523 30/47
2,648,129 A * 8/1953 Streeter ..... B26B 21/18 30/49
2,678,490 A * 5/1954 Winslow ..... B26B 21/52 30/527
3,045,342 A * 7/1962 Diehl ..... B26B 21/00 30/527
3,646,672 A 3/1972 Braginetz
4,461,078 A * 7/1984 Carreker ..... B26B 21/40 30/47
4,638,560 A 1/1987 Higashi
5,357,680 A * 10/1994 Monistere ..... B26B 21/525 30/32
5,497,551 A 3/1996 Apprille, Jr.
5,839,198 A * 11/1998 McCoy ..... B26B 21/52 30/537
6,029,356 A * 2/2000 Sprinkle ..... B26B 21/08 30/526
6,112,421 A 9/2000 Greene
(Continued)

*Primary Examiner* — Jason Daniel Prone

(57) ABSTRACT

An adjustably positionable razor assembly includes a body. A handle is movably coupled to a top of the body. An articulating member is rotatably coupled to a bottom of the body. A head is pivotally coupled to a bottom of the articulating member. A blade cartridge is coupled to the head.

12 Claims, 5 Drawing Sheets

(56) References Cited

U.S. PATENT DOCUMENTS

| | | | | |
|---|---|---|---|---|
| 6,493,950 | B1 * | 12/2002 | Kludjian | B26B 21/22 30/50 |
| 6,550,148 | B2 | 4/2003 | Cecil | |
| D484,769 | S * | 1/2004 | Cheung | B26B 21/527 D8/98 |
| 6,694,626 | B2 * | 2/2004 | Kludjian | B26B 21/22 30/526 |
| 6,823,594 | B2 * | 11/2004 | Kludjian | B26B 21/22 30/526 |
| D612,102 | S | 3/2010 | Kling et al. | |
| 7,805,845 | B2 | 10/2010 | Kludjian et al. | |
| 2008/0172882 | A1 * | 7/2008 | Eger | B26B 21/40 30/49 |
| 2009/0277023 | A1 * | 11/2009 | Coelho | B26B 21/222 30/526 |
| 2011/0113631 | A1 * | 5/2011 | Zdunek | A45D 27/00 30/34.05 |
| 2011/0283540 | A1 * | 11/2011 | Wetteroff | B26B 21/523 30/47 |
| 2014/0101947 | A1 * | 4/2014 | Samuels | B26B 21/4062 30/527 |
| 2016/0193740 | A1 * | 7/2016 | Phillips | B26B 21/527 30/34.05 |
| 2017/0043492 | A1 * | 2/2017 | Robertson | B26B 21/521 30/50 |

* cited by examiner

ADJUSTABLY POSITIONABLE RAZOR ASSEMBLY

CROSS REFERENCE TO OTHER APPLICATIONS

This is a continuation in part of application Ser. No. 13/653,990 filed Oct. 17, 2012, abandoned as of Oct. 26, 2015.

BACKGROUND OF THE DISCLOSURE

Field of the Disclosure

The disclosure relates to adjustably positionable razor devices and more particularly pertains to a new adjustably positionable razor device for shaving a user's body.

SUMMARY OF THE DISCLOSURE

An embodiment of the disclosure meets the needs presented above by generally comprising a body. A handle is movably coupled to a top of the body. An articulating member is movably coupled to a bottom of the body. A head is movably coupled to a bottom of the articulating member. A blade is coupled to the head.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
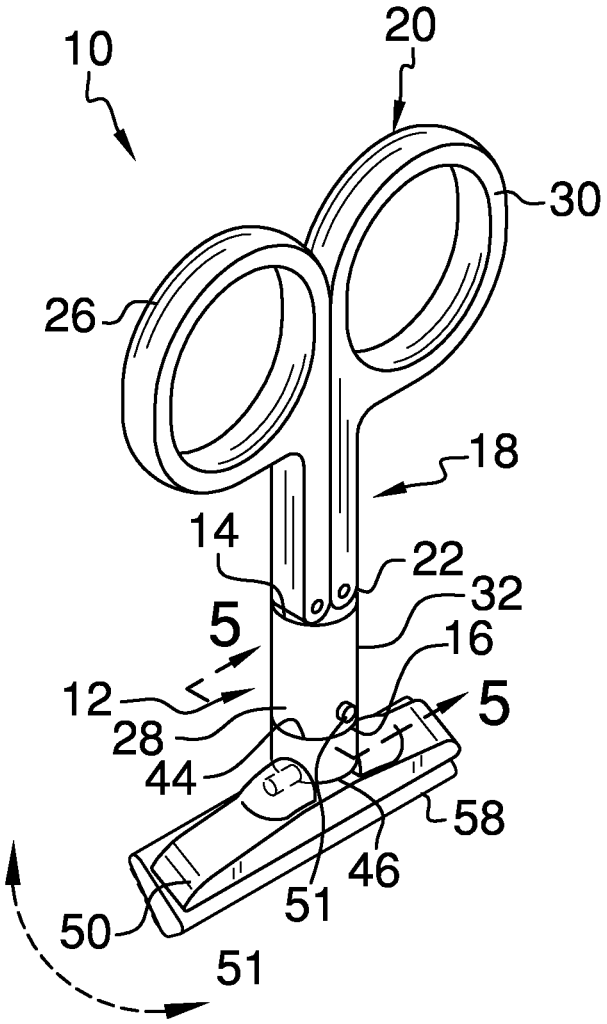
FIG. 1 is a perspective view of an adjustably positionable razor assembly according to an embodiment of the disclosure.

With reference now to the drawings, and in particular to FIGS. 1 through 5 thereof, a new adjustably positionable razor device embodying the principles and concepts of an embodiment of the disclosure and generally designated by the reference numeral 10 will be described.

As best illustrated in FIGS. 1 through 5, the adjustably positionable razor assembly 10 generally comprises a body

12 that has a top end 14 and a bottom end 16. A handle 18 is provided that has a first end 20 and a second end 22. The first end 20 of the handle 18 comprises a closed loop so the first end 20 may gripped by a user 24. The second end 22 of the handle 18 is pivotally coupled to the top end 14 of the body 12. The handle 18 may a length between 3 cm and 5 cm.

The handle 18 is positionable in a deployed position that has the handle 18 extending upwardly from the body 12. The handle 18 is positionable in a stored position that has the handle 18 extending laterally away from the body 12. The handle 18 is one of a pair of the handles 18. A first one of the handles 26 is positioned proximate a first lateral side 28 of the body 12. A second one of the handles 30 is positioned proximate a second lateral side 32 of the body 12.

A tab 34 extends outwardly from a first lateral side 36 of the second handle 30. The tab 34 includes a barb 68. A groove 38 extends into a second lateral side 40 of the first handle 26. The groove 38 insertably receives the tab 34 such that the barb 68 engages the groove 38 when the handles 18 are positioned in the deployed position. Thusly, the tab 34 may retain the first 26 and second 30 handles in the deployed position. The tab 34 and groove 38 may each be centrally positioned on the associated one of the first 26 and second 30 handles.

Figure 5:
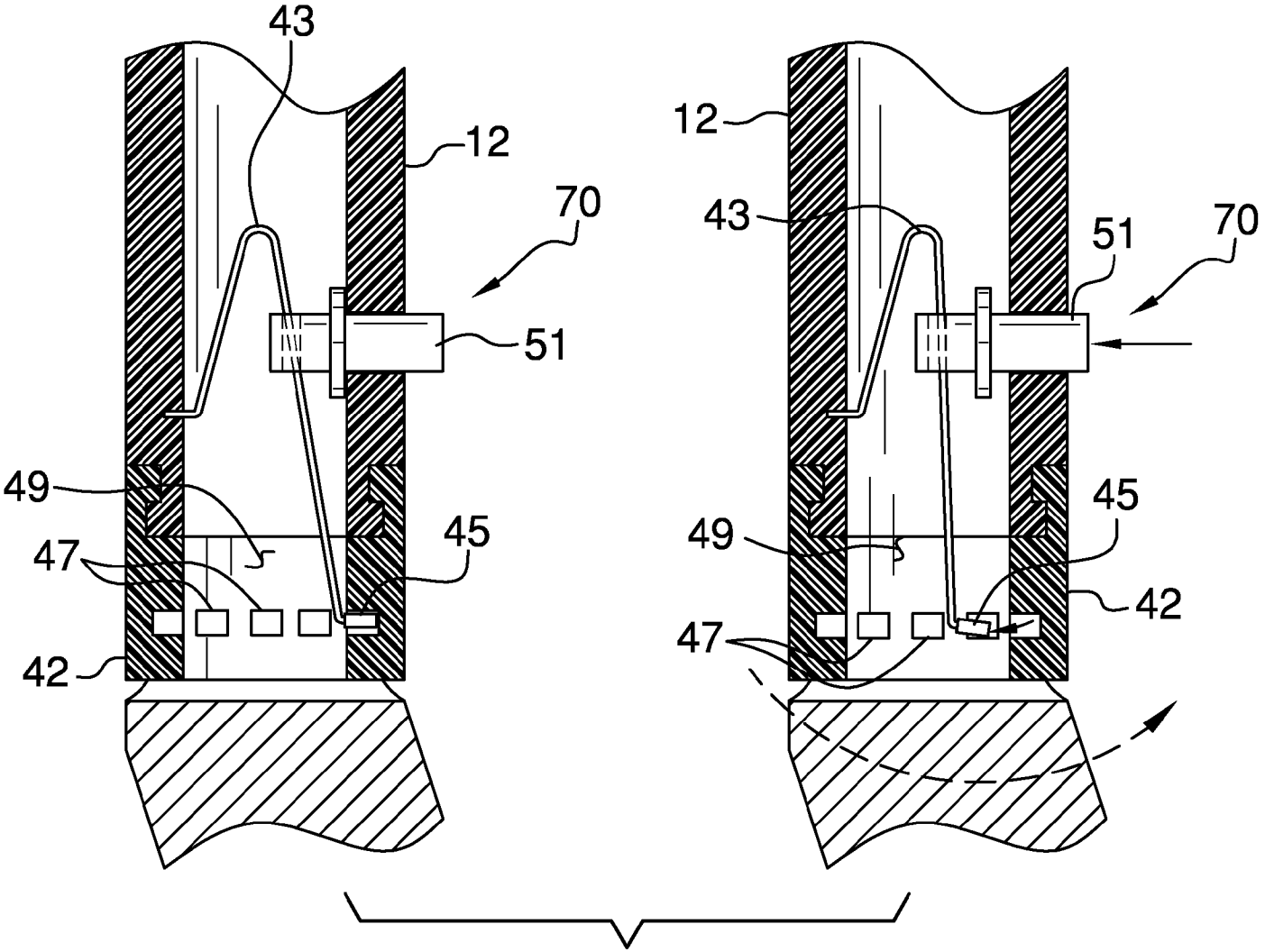
FIG. 5 is a cross sectional view taken along line 5-5 of FIG. 1 of an embodiment of the disclosure.

An articulating member 42 has a first end 44 and a second end 46. The first end 44 of the articulating member 42 is pivotally and rotatably coupled to the bottom end 16 of the body 12. The articulating member 42 is positionable at a selected angle with respect to a rear side 48 of the body 12. The articulating member 42 is positionable at a selected lateral angle with respect to a longitudinal axis extending through the bottom 16 and top 14 ends of the body 12. The articulating member 42 may be rotated about the longitudinal axis of the body as shown in FIG. 5.

A locking mechanism 70 engages the articulating member 42 to the body 12 to selectively hold the articulating member in a static position and prevent rotation of the articulating member relative to the body 12. The locking mechanism 70 includes a biasing member 43 which is coupled to the body 12. The biasing member 43 is positioned within an interior of the body 12 so a free end 45 of the biasing member 43 is biased toward a selected one of a plurality of grooves 47 extending into an inner surface 49 of the articulating member 42. The free end 45 of the biasing member 43 retains the articulating member 42 at a selected rotated position. An actuator 51 is movably coupled to the body 12 proximate the bottom end 16 of the body 12. The actuator 51 selectively engages the biasing member 43 so the free end 45 of the biasing member 43 is urged away from the selected one of the plurality of grooves 47. The articulating member 42 is freely rotatable about the longitudinal axis extending through the body 12 when the actuator 51 is actuated.

Figure 2:
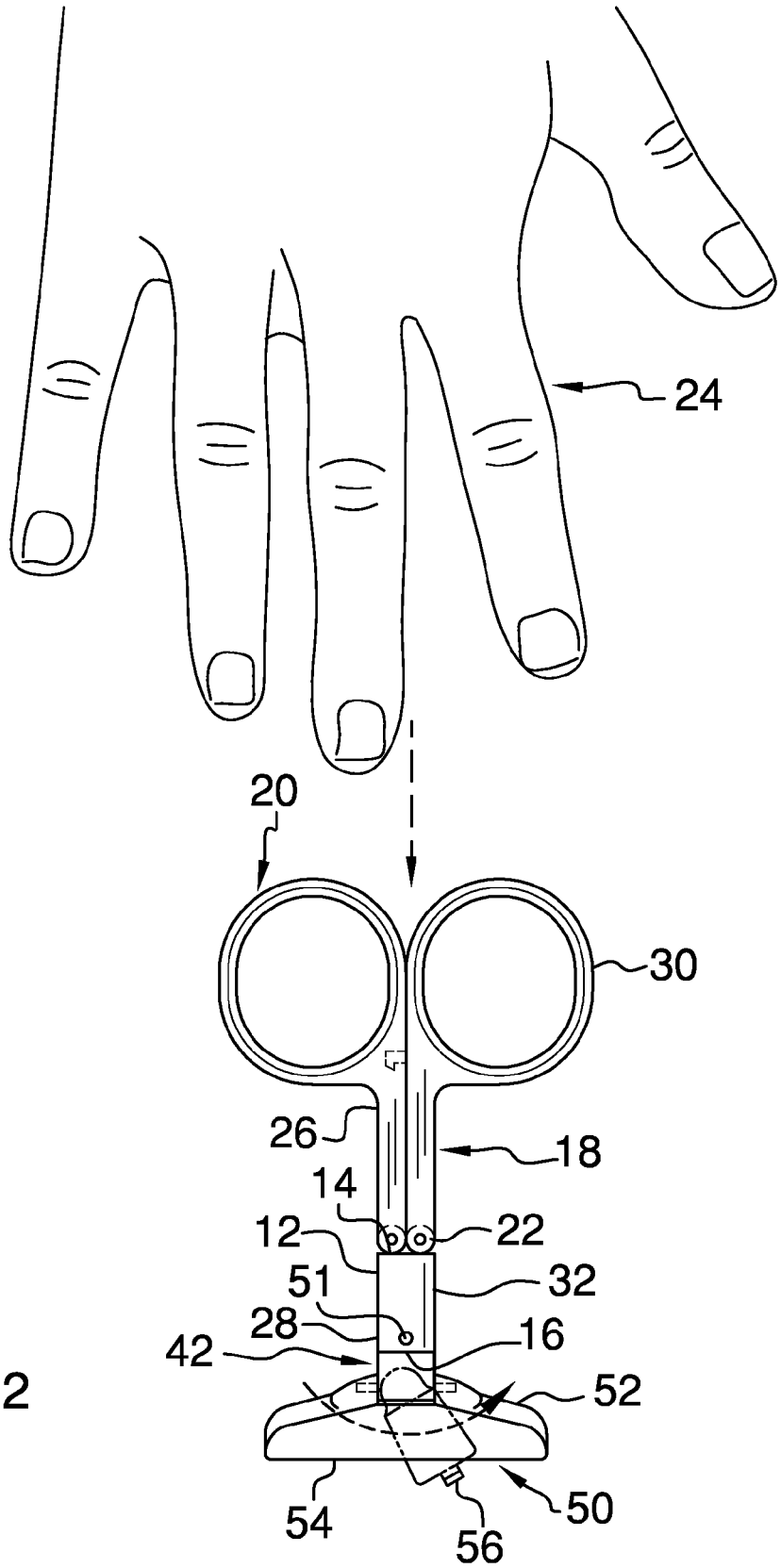
FIG. 2 is a front side view of an embodiment of the disclosure.
Figure 3:
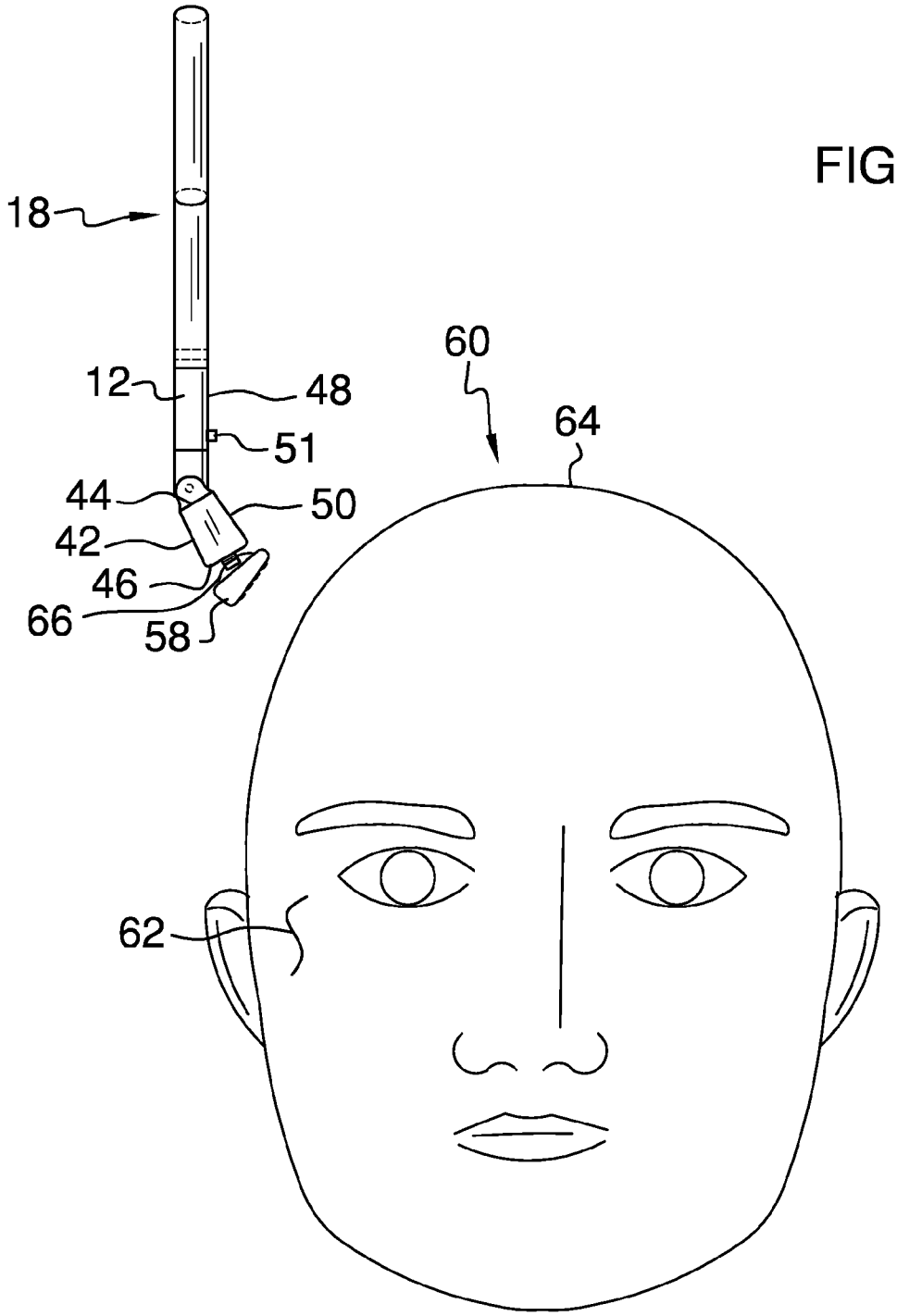
FIG. 3 is a left side view of an embodiment of the disclosure.
Figure 4:
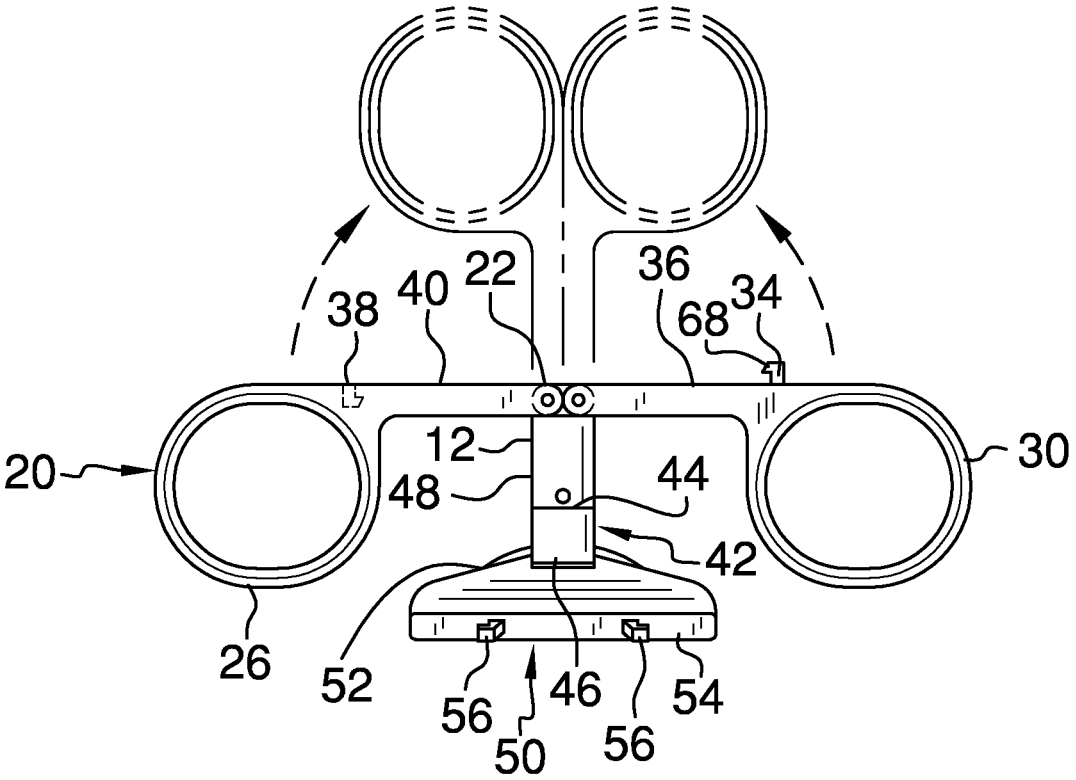
FIG. 4 is a back side view of an embodiment of the disclosure.

A head 50 has a top end 52 and a bottom end 54. The top end 52 of the head 50 is pivotally coupled to the second end 46 of the articulating member 42 as can be seen in FIGS. 1 and 2. A pair of tabs 56 is coupled to and extends away from the bottom end 54 of the head 50. The head 50 may have a width between 2 cm and 4 cm. A blade cartridge 58 has connectors 66 engaging each of the tabs 56 in a conventional manner so the blade cartridge 58 may be removably coupled to the head 50 and pivot relative to the body 12 while coupled to the head 50. The blade cartridge 58 may be a disposable razor blade of any conventional design.

In use, the assembly 10 may be used with the handles 18 in the deployed or stored position. The articulating member 42 may be rotated about the longitudinal axis to more efficiently shave the user's head 64 or other parts of the user's body 60. The blade cartridge 58 may be replaced at any desired interval of time.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

We claim:

1. An adjustably positionable razor assembly comprising:
a body;
a handle, said handle having a first end and a second end, said first end of said handle comprising a closed loop whereby said first end is configured to be gripped by a user, said second end of said handle being pivotally coupled to a top end of said body;
an articulating member rotatably coupled to a bottom of said body;
a head pivotally coupled to a bottom of said articulating member; and
a blade cartridge coupled to said head.

2. The assembly according to claim 1, further including said handle being positionable in a deployed position in which said handle is substantially linearly aligned with said body, said handle being positionable in a stored position in which said handle is substantially transverse to said body.

3. The assembly according to claim 1, further including said handle being one of a pair of said handles, a first one of said handles being positioned proximate a first lateral side of said body, a second one of said handles being positioned proximate a second lateral side of said body.

4. The assembly according to claim 1, further comprising:
said handle being one of a pair of handles, each being pivotally coupled to said top end of said body;
said pair of handles being positionable in a deployed position;
a groove extending into a second lateral side of a first one of said handles;
a tab extending outwardly from a first lateral side of a second one of said handles, said tab having a barb; and
said groove insertably receiving said tab such that said barb engages said groove when said handles are positioned in said deployed position whereby said tab is engaged to said first one of said handles to retain said handles in said deployed position.

5. The assembly according to claim 1, further including said articulating member having a first end and a second end, said first end of said articulating member being rotatably coupled to a bottom end of said body.

6. The assembly according to claim 1, further including a locking mechanism selectively engaging said articulating member to said head whereby said articulating member is positionable at a selectable angle with respect to a rear side of said body.

7. The assembly according to claim 6, further comprising:
said head being pivotally coupled to said articulating member;
a pair of tabs coupled to said head;
said blade cartridge engaging each of said tabs whereby said blade cartridge is removably coupled to said head.

8. The assembly according to claim 6, wherein said locking mechanism further comprises:
a biasing member coupled to said body, said biasing member being positioned within an interior of said body wherein a free end of said biasing member is biased toward a selected one of a plurality of grooves extending into an inner surface of said articulating member wherein said free end of said biasing member retains said articulating member at a selected rotated position; and
an actuator movably coupled to said body proximate a bottom end of said body, said actuator selectively engaging said biasing member wherein said free end of said biasing member is urged away from the selected one of said plurality of grooves.

9. The assembly according to claim 1, further comprising:
said articulating member having a first end and a second end;
said head having a top end and a bottom end; and
said top end of said head being pivotally coupled to said second end of said articulating member whereby said head is pivotable relative to said articulating member.

10. The assembly according to claim 1, further comprising:
said head having a top end and a bottom end; and
a pair of tabs coupled to and extending away from said bottom end of said head.

11. The assembly according to claim 1, further comprising:
said head having a top end and a bottom end;
a pair of tabs coupled to and extending away from said bottom end of said head; and
said blade cartridge engaging each of said tabs whereby said blade is configured to be removably coupled to said head.

12. An adjustably positionable razor assembly comprising:
a body having a top end and a bottom end;
a first handle and a second handle, each of said first handle and said second handle having a respective first end and a respective second end, said first end of each of said first handle and said second handle comprising a respective closed loop whereby said first end of each of said first handle and said second handle is configured to be gripped by a user, said second end of each of said first handle and said second handle being pivotally coupled to said top end of said body, each of said first handle and said second handle being positionable in a deployed position in which each of said first handle and said second handle is substantially linearly aligned with said body, each of said first handle and said second handle being positionable in a stored position in which each of said first handle and said second handle is substantially transverse to said body, said first handle being positioned proximate a first lateral side of said body, said second handle being positioned proximate a second lateral side of said body;
a tab extending outwardly from a first lateral side of said second handle, said tab having a barb;
a groove extending into a second lateral side of said first handle, said groove insertably receiving said tab such that said barb engages said groove when said handles are positioned in said deployed position;

an articulating member having a first end and a second end, said first end of said articulating member being rotatably coupled to said bottom end of said body, said articulating member being positionable at a selected angle with respect to a rear side of said body;

a locking mechanism engaging said body and said articulating member, said locking mechanism holding said articulating member in a static position relative to said body, said locking mechanism including a biasing member coupled to said body, said biasing member being positioned within an interior of said body wherein a free end of said biasing member is biased toward a selected one of a plurality of grooves extending into an inner surface of said articulating member wherein said free end of said biasing member retains said articulating member at a selected rotated position, and an actuator movably coupled to said body proximate said bottom end of said body, said actuator selectively engaging said biasing member wherein said free end of said biasing member is urged away from the selected one of said plurality of grooves;

a head having a top end and a bottom end, said top end of said head being pivotally coupled to said second end of said articulating member; and a blade cartridge being configured to be removably coupled to said head.

* * * * *